US012673809B2

(12) United States Patent
Holley, Jr. et al.

(10) Patent No.: US 12,673,809 B2
(45) Date of Patent: Jul. 7, 2026

(54) CARRIER FOR CONTAINERS

(71) Applicant: Graphic Packaging International, LLC, Atlanta, GA (US)

(72) Inventors: John Murdick Holley, Jr., Lawrenceville, GA (US); Meng-Chuan Wu, Norcross, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 154 days.

(21) Appl. No.: 17/875,755

(22) Filed: Jul. 28, 2022

(65) Prior Publication Data

US 2023/0031526 A1 Feb. 2, 2023

Related U.S. Application Data

(60) Provisional application No. 63/203,724, filed on Jul. 29, 2021.

(51) Int. Cl.
*B65D 71/42* (2006.01)
*B65B 17/02* (2006.01)

(52) U.S. Cl.
CPC ..... *B65D 71/42* (2013.01); *B65B 17/025* (2013.01); *B65D 2571/00265* (2013.01);
(Continued)

(58) Field of Classification Search
CPC ..... B65D 71/42; B65D 2571/00265; B65D 2571/00444; B65D 2571/00524; B65D 2571/0066; B65B 17/025
(Continued)

(56) References Cited

U.S. PATENT DOCUMENTS 1,527,399 A 2/1925 Davidson
2,289,859 A 7/1942 Arthur
(Continued)

FOREIGN PATENT DOCUMENTS

AT 399701 B 7/1995
AU 2009200835 A1 9/2009
(Continued)

OTHER PUBLICATIONS

"Florida brewery unveils six-pack rings that spare sea turtles, not snare them," by Thomas Leavy, CBSNews.com. Date posted: May 24, 2018. Site visited: Sep. 12, 2022. Available online: https://www.cbsnews.com/news/ florida-saltwater-brewery-non-plastic-six-pack-rings-spare-sea-turtles/ (Year: 2018).
(Continued)

*Primary Examiner* — Andrew D Perreault
(74) *Attorney, Agent, or Firm* — Andrew N. Claerbout; FisherBroyles, LLP

(57) ABSTRACT

A carrier for holding a plurality of containers includes a central panel and container retention features for engaging the plurality of containers, the container retention features include a plurality of container retention openings for at least partially receiving a respective container of the plurality of containers, at least one container retention tab positioned extending into a respective container retention opening for engaging a respective container of the plurality of containers, and at least one edge retainer extending from a respective container retention tab of the plurality of container retention tabs and for facilitating engagement of the carrier with the plurality of containers.

16 Claims, 8 Drawing Sheets

(52) U.S. Cl.
CPC ..... *B65D 2571/00444* (2013.01); *B65D 2571/00524* (2013.01); *B65D 2571/0066* (2013.01)

(58) Field of Classification Search
USPC ..... 206/201
See application file for complete search history.

(56) References Cited

U.S. PATENT DOCUMENTS 2,320,440 A 6/1943 Kruea
2,331,038 A 10/1943 Meller
2,397,376 A 3/1946 Caldwell
2,397,716 A 4/1946 Wendler
2,522,950 A 9/1950 Keith
2,594,376 A 4/1952 Arneson
2,594,377 A 4/1952 Arneson
2,737,326 A 3/1956 Toensmeier
2,798,603 A 7/1957 Grinspoon
2,814,385 A 11/1957 Stone
2,823,062 A 2/1958 Toensmeier
2,929,181 A 3/1960 Poupitch
2,936,070 A 5/1960 Poupitch
2,950,041 A 8/1960 Stone
2,965,410 A 12/1960 Hughes
3,001,647 A 9/1961 Liss
3,005,654 A 10/1961 Stone et al.
3,046,711 A 7/1962 Harrison
3,061,141 A 10/1962 Cote
3,094,210 A 6/1963 Van Der Berg
3,099,475 A 7/1963 Manizza
3,118,537 A 1/1964 Copping
3,128,034 A 4/1964 Weiss
3,137,109 A 6/1964 Rapata
3,146,885 A 9/1964 Grantham
3,156,358 A 11/1964 Randrup
RE25,781 E 5/1965 Akiereb
3,200,944 A 8/1965 Rapata
3,223,308 A 12/1965 Weiss
3,245,711 A 4/1966 Dantoin
3,257,066 A 6/1966 Williams
3,281,180 A 10/1966 Spery
3,302,784 A 2/1967 Copping
3,310,334 A 3/1967 Murphy
3,317,234 A 5/1967 Burford
3,387,879 A 6/1968 Wood
3,404,912 A 10/1968 Watts
3,410,596 A 11/1968 Slevin, Jr.
3,432,202 A 3/1969 Ebelhardt
3,463,535 A 8/1969 Beart
3,515,272 A 6/1970 Gal
3,528,697 A 9/1970 Wood
3,587,847 A 6/1971 Graser
3,601,253 A 8/1971 Poupitch
3,601,439 A 8/1971 Poupitch
3,612,266 A 10/1971 Graser
D222,579 S 11/1971 Oglesbee
3,627,121 A 12/1971 Deasy
3,653,503 A 4/1972 Arneson
3,653,504 A 4/1972 Saumsiegle
3,664,497 A 5/1972 Mascia
3,693,787 A 9/1972 Duerr
3,698,550 A 10/1972 Graser
3,701,416 A 10/1972 Lawrence
3,722,945 A 3/1973 Wood
3,726,558 A 4/1973 Klygis
3,734,278 A 5/1973 Kerrigan
3,767,041 A 10/1973 Graser
3,876,066 A 4/1975 Klygis
3,897,873 A 8/1975 Graser
3,924,739 A 12/1975 Gravesteijn
3,942,631 A 3/1976 Sutherland et al.
4,029,204 A 6/1977 Manizza
4,078,357 A 3/1978 Ida
4,111,298 A 9/1978 Mascia
4,120,396 A 10/1978 Mascia
4,136,772 A 1/1979 Mascia
4,155,502 A 5/1979 Forte
4,190,149 A 2/1980 Oliff et al.
4,192,540 A 3/1980 Oliff
D257,001 S 9/1980 Oliff
4,244,617 A 1/1981 Manizza
4,296,858 A 10/1981 Platt
4,304,329 A 12/1981 Graser
D265,292 S 7/1982 Killy
4,339,032 A 7/1982 Wood
D265,979 S 8/1982 Arfert
4,372,599 A 2/1983 Kiedaisch et al.
4,378,879 A 4/1983 Killy
4,382,505 A 5/1983 Sutherland et al.
4,441,611 A 4/1984 Sommariva
4,453,630 A 6/1984 Helms
4,471,870 A 9/1984 Uhlig
4,518,081 A 5/1985 de Larosiere
4,523,676 A 6/1985 Barrash
4,566,591 A 1/1986 Turtschan
4,703,847 A 11/1987 Oliff
D294,331 S 2/1988 Panazzolo
4,736,977 A 4/1988 Killy
4,784,266 A 11/1988 Chaussadas
D304,017 S 10/1989 Oliff
4,911,288 A 3/1990 Dantoin, Jr.
4,911,289 A 3/1990 Bird
4,974,726 A 12/1990 Klygis et al.
5,002,225 A 3/1991 Bienaime
5,065,862 A 11/1991 Mousseau
5,103,971 A * 4/1992 Schuster ..... B65D 71/48 206/153
5,125,506 A 6/1992 Galbierz et al.
5,135,104 A 8/1992 Jorba
5,139,147 A 8/1992 Sutherland
D329,807 S 9/1992 Heider
5,186,321 A 2/1993 Fadus
5,188,225 A 2/1993 Jorba
5,193,673 A 3/1993 Rathbone et al.
5,201,412 A 4/1993 Schuster et al.
5,230,425 A 7/1993 Edqvist et al.
5,246,113 A 9/1993 Schuster
5,263,299 A 11/1993 Galbierz et al.
5,267,644 A 12/1993 Tsao
5,282,348 A 2/1994 Dampier et al.
5,285,892 A 2/1994 Adami
5,297,673 A 3/1994 Sutherland
5,310,050 A 5/1994 Sutherland
5,310,051 A 5/1994 Sutherland
5,314,224 A 5/1994 Bates
5,318,178 A 6/1994 Davies et al.
5,320,216 A 6/1994 Pangborn
5,323,895 A 6/1994 Sutherland et al.
5,328,024 A 7/1994 Sutherland
5,335,774 A 8/1994 Ganz
5,351,815 A 10/1994 Fogle et al.
5,351,816 A 10/1994 Sutherland et al.
5,351,817 A 10/1994 Sutherland
5,355,999 A 10/1994 Sutherland
5,360,104 A 11/1994 Sutherland
5,390,784 A 2/1995 Sutherland
5,407,065 A 4/1995 Sutherland
5,415,278 A 5/1995 Sutherland
5,425,446 A 6/1995 Weaver
5,443,153 A 8/1995 Sutherland
5,445,262 A 8/1995 Sutherland
5,452,799 A 9/1995 Sutherland
5,469,687 A 11/1995 Olson
5,474,172 A 12/1995 Zavatone et al.
5,484,053 A 1/1996 Harris
5,485,914 A 1/1996 Martin
5,487,464 A 1/1996 Galbierz et al.
5,490,593 A 2/1996 Gordon et al.
5,503,267 A 4/1996 Sutherland
5,520,283 A 5/1996 Sutherland
5,524,756 A 6/1996 Sutherland
5,542,536 A 8/1996 Sutherland
5,551,566 A 9/1996 Sutherland
5,553,704 A 9/1996 Gordon et al.

(56) References Cited

U.S. PATENT DOCUMENTS

| | | | |
|---|---|---|---|
| 5,553,705 | A | 9/1996 | Bakx |
| 5,573,111 | A | 11/1996 | Gordon |
| 5,590,776 | A | 1/1997 | Galbierz |
| 5,593,027 | A | 1/1997 | Sutherland |
| 5,609,247 | A | 3/1997 | Appleton |
| 5,609,251 | A | 3/1997 | Harris |
| 5,609,379 | A | 3/1997 | Harrelson |
| 5,627,150 | A | 5/1997 | Peterson |
| 5,639,137 | A | 6/1997 | Bakx |
| 5,682,982 | A | 11/1997 | Stonehouse |
| 5,706,936 | A | 1/1998 | Bernstein |
| 5,711,419 | A | 1/1998 | Beales et al. |
| 5,718,330 | A | 2/1998 | Auffret et al. |
| 5,735,394 | A | 4/1998 | Harrelson |
| 5,746,310 | A | 5/1998 | Slomski |
| 5,762,193 | A | 6/1998 | Marco |
| 5,791,463 | A | 8/1998 | Negelen |
| 5,791,464 | A | 8/1998 | Galbierz et al. |
| 5,816,391 | A | 10/1998 | Harris |
| 5,845,776 | A | 12/1998 | Galbierz et al. |
| 5,878,876 | A | 3/1999 | Galbierz et al. |
| 5,960,945 | A | 10/1999 | Sutherland |
| 6,039,181 | A | 3/2000 | Whiteside |
| 6,059,099 | A | 5/2000 | Galbierz |
| 6,082,532 | A | 7/2000 | Miess |
| 6,145,656 | A | 11/2000 | Marco |
| 6,168,012 | B1 | 1/2001 | Galbierz |
| 6,293,392 | B1 | 9/2001 | Galbierz |
| 6,315,111 | B1 | 11/2001 | Sutherland |
| 6,394,272 | B1 | 5/2002 | Domansky |
| 6,896,130 | B2 | 5/2005 | Theelen |
| D506,925 | S | 7/2005 | Plumer |
| 7,011,209 | B2 | 3/2006 | Sutherland et al. |
| 7,048,113 | B2 | 5/2006 | Gomes |
| 7,360,647 | B2 | 4/2008 | Ogg |
| 7,690,507 | B2 | 4/2010 | Sutherland |
| 7,721,878 | B2 | 5/2010 | Requena |
| 7,762,397 | B2 | 7/2010 | Coltri-Johnson et al. |
| 7,789,231 | B2 | 9/2010 | Requena |
| 7,823,721 | B2 | 11/2010 | Sutherland et al. |
| 7,913,844 | B2 | 3/2011 | Spivey, Sr. |
| 8,056,709 | B2 | 11/2011 | Sutherland |
| 8,096,413 | B2 | 1/2012 | DePaula |
| 8,113,968 | B2 | 2/2012 | Fittler |
| 8,162,135 | B2 | 4/2012 | Oliveira |
| 8,353,398 | B2 | 1/2013 | DePaula et al. |
| 8,387,784 | B2 | 3/2013 | Gonzalez et al. |
| 8,443,968 | B2 | 5/2013 | DePaula |
| 8,464,866 | B2 | 6/2013 | Sutherland et al. |
| 8,469,184 | B2 | 6/2013 | Spivey, Sr. |
| 8,602,209 | B2 | 12/2013 | Jones et al. |
| 8,631,932 | B2 | 1/2014 | Holley, Jr. |
| 8,701,878 | B2 | 4/2014 | Spivey, Sr. |
| 8,925,720 | B2 | 1/2015 | Sutherland et al. |
| 8,936,149 | B2 | 1/2015 | Smalley |
| 8,955,674 | B2 | 2/2015 | Spivey, Sr. et al. |
| 9,004,344 | B2 | 4/2015 | Smith |
| 9,079,699 | B2 | 7/2015 | Holley, Jr. |
| 9,169,050 | B2 | 10/2015 | Spivey, Sr. |
| 9,284,090 | B2 | 3/2016 | Lettre |
| 9,359,093 | B2 | 6/2016 | DePaula et al. |
| 9,376,250 | B2 | 6/2016 | Spivey, Sr. |
| D767,408 | S | 9/2016 | Shuster |
| 9,446,891 | B2 | 9/2016 | Jones et al. |
| 9,511,916 | B2 | 12/2016 | Holley, Jr. |
| D786,702 | S | 5/2017 | Borg et al. |
| 9,669,976 | B2 | 6/2017 | Kastanek et al. |
| 9,676,535 | B2 | 6/2017 | Spivey, Sr. |
| 10,077,131 | B2 | 9/2018 | Lettre |
| 10,293,998 | B2 | 5/2019 | Borg et al. |
| D881,021 | S | 4/2020 | Bandinu |
| D881,718 | S | 4/2020 | Bandinu |
| 10,836,550 | B2 | 11/2020 | Zacherle |
| D918,057 | S | 5/2021 | L'Heureux |
| D918,058 | S | 5/2021 | L'Heureux |
| 11,014,727 | B2 | 5/2021 | McCree |
| D920,809 | S | 6/2021 | Chesnet et al. |
| D921,493 | S | 6/2021 | Chesnet |
| D923,416 | S | 6/2021 | Luciano |
| 11,027,904 | B2 | 6/2021 | McCree |
| 11,027,905 | B2 | 6/2021 | Ford |
| 11,180,301 | B2 | 11/2021 | Smalley |
| D944,656 | S | 3/2022 | Spivey, Sr. |
| D946,416 | S | 3/2022 | Smalley |
| D946,417 | S | 3/2022 | Gonzalez Manzano |
| D946,418 | S | 3/2022 | Gonzalez Manzano |
| D946,419 | S | 3/2022 | Gonzalez Manzano |
| D946,420 | S | 3/2022 | Gonzalez Manzano |
| D946,421 | S | 3/2022 | Gonzalez Manzano |
| 11,261,013 | B2 | 3/2022 | Smalley |
| 11,261,014 | B2 | 3/2022 | Zacherle |
| 11,286,094 | B2 | 3/2022 | Gonzalez Manzano |
| D955,889 | S | 6/2022 | Gonzalez Manzano |
| D955,890 | S | 6/2022 | Gonzalez Manzano |
| 11,365,039 | B2 | 6/2022 | Berga Ferres |
| D956,574 | S | 7/2022 | Gonzalez Manzano |
| 11,401,094 | B2 | 8/2022 | McCree |
| 11,401,095 | B2 | 8/2022 | Rosenbrien |
| 11,420,802 | B2 | 8/2022 | Kooc |
| D962,789 | S | 9/2022 | Noel |
| 11,447,317 | B2 | 9/2022 | Zacherle et al. |
| D974,923 | S | 1/2023 | Smalley |
| D983,049 | S | 4/2023 | McCree |
| D984,279 | S | 4/2023 | McCree |
| D984,282 | S | 4/2023 | McCree |
| 11,628,994 | B2 | 4/2023 | McCree |
| D1,000,290 | S | 10/2023 | Thompson |
| 12,071,291 | B2 | 8/2024 | Ford |
| 2002/0195371 | A1 | 12/2002 | Brown |
| 2003/0080004 | A1 | 5/2003 | Olsen et al. |
| 2003/0213705 | A1 | 11/2003 | Woog |
| 2004/0007480 | A1 | 1/2004 | Pattee et al. |
| 2004/0134799 | A1 | 7/2004 | Mattson |
| 2004/0206639 | A1 | 10/2004 | Karlsson |
| 2004/0211695 | A1 | 10/2004 | Karlsson |
| 2004/0226833 | A1 | 11/2004 | Daniel |
| 2005/0127151 | A1 | 6/2005 | Johnson |
| 2005/0199513 | A1 | 9/2005 | Bakx et al. |
| 2006/0255114 | A1 | 11/2006 | Hand et al. |
| 2007/0000794 | A1 | 1/2007 | Requena |
| 2007/0080084 | A1 | 4/2007 | Sutherland |
| 2007/0163908 | A1 | 7/2007 | Sutherland |
| 2007/0193889 | A1 | 8/2007 | Olsen et al. |
| 2008/0257763 | A1 | 10/2008 | Ogg |
| 2009/0101526 | A1 | 4/2009 | Sutherland et al. |
| 2009/0127147 | A1 | 5/2009 | Sutherland |
| 2010/0078337 | A1 | 4/2010 | Sutherland et al. |
| 2010/0264043 | A1 | 10/2010 | DePaula |
| 2011/0000799 | A1 | 1/2011 | Gonzalez |
| 2012/0080328 | A1 | 4/2012 | DePaula |
| 2012/0138489 | A1 | 6/2012 | Holley, Jr. |
| 2015/0191287 | A1 | 7/2015 | L'Heureux et al. |
| 2016/0159546 | A1 | 6/2016 | Cassidy |
| 2016/0280436 | A1 | 9/2016 | Taylor et al. |
| 2016/0325899 | A1 | 11/2016 | L'Heureux et al. |
| 2018/0029768 | A1 | 2/2018 | Blin |
| 2018/0111734 | A1 | 4/2018 | Jego |
| 2018/0222650 | A1 | 8/2018 | Zacherle |
| 2018/0362234 | A1 | 12/2018 | L'Heureux et al. |
| 2019/0119019 | A1 | 4/2019 | Patton |
| 2019/0135512 | A1 | 5/2019 | Kooc |
| 2019/0233145 | A1 | 8/2019 | Kooc |
| 2020/0010255 | A1 | 1/2020 | Zacherle et al. |
| 2020/0079564 | A1 | 3/2020 | Ford |
| 2020/0189817 | A1 | 6/2020 | Smalley |
| 2020/0189818 | A1 | 6/2020 | McCree |
| 2020/0189819 | A1 | 6/2020 | McCree |
| 2020/0189821 | A1 | 6/2020 | Smalley |
| 2020/0189822 | A1 | 6/2020 | Smalley |
| 2020/0223612 | A1 | 7/2020 | Swenson |
| 2021/0061502 | A1 | 3/2021 | Johnston |
| 2021/0094742 | A1 | 4/2021 | Gonzalez Manzano |
| 2021/0276776 | A1 | 9/2021 | Zammit |
| 2021/0316921 | A1 | 10/2021 | Holtz |

(56) References Cited

U.S. PATENT DOCUMENTS

| | | | |
|---|---|---|---|
| 2021/0331847 | A1 | 10/2021 | Gonzalez Manzano |
| 2021/0331848 | A1 | 10/2021 | Gonzalez Manzano |
| 2021/0339928 | A1 | 11/2021 | Blin |
| 2022/0009685 | A1 | 1/2022 | Thompson |
| 2022/0097941 | A1 | 3/2022 | McCree |
| 2022/0396407 | A1 | 12/2022 | Thompson |
| 2022/0411155 | A1 | 12/2022 | Ford |
| 2022/0411156 | A1 | 12/2022 | Ford |
| 2023/0019145 | A1 | 1/2023 | Thompson |
| 2023/0031526 | A1 | 2/2023 | Holley, Jr. |
| 2023/0286717 | A1 | 9/2023 | Garnier |
| 2023/0303300 | A1 | 9/2023 | Spivey, Sr. |
| 2023/0322458 | A1 | 10/2023 | Barrette |
| 2023/0382619 | A1 | 11/2023 | Ford |
| 2024/0034532 | A1 | 2/2024 | Merzeau |
| 2024/0253882 | A1 | 8/2024 | Merzeau |

FOREIGN PATENT DOCUMENTS

| | | | |
|---|---|---|---|
| CA | 2133827 | | 10/1993 |
| CA | 2189766 | | 10/1996 |
| DE | 298 13 672 | U1 | 11/1998 |
| DE | 203 19 247 | U1 | 5/2004 |
| DE | 20 2009 002 012 | U1 | 5/2009 |
| DE | 10 2009 059 047 | A1 | 6/2011 |
| DE | 20 2018 106 53 | | 1/2019 |
| EM | 008574800-0008 | | 12/2021 |
| EP | 0 051 413 | A1 | 5/1982 |
| EP | 0 060 504 | A2 | 9/1982 |
| EP | 0 057 437 | B1 | 5/1985 |
| EP | 0 428 354 | A1 | 5/1991 |
| EP | 0 496 807 | | 6/1993 |
| EP | 0 636 096 | | 2/1995 |
| EP | 0 715 593 | A1 | 6/1996 |
| EP | 0 398 835 | B1 | 10/1996 |
| EP | 1 340 691 | A1 | 9/2003 |
| EP | 1 401 727 | B1 | 6/2006 |
| EP | 1 910 187 | B1 | 3/2009 |
| EP | 2 067 713 | A1 | 6/2009 |
| EP | 1 528 007 | B1 | 10/2010 |
| EP | 2739547 | B1 | 7/2017 |
| EP | 3 666 684 | A1 | 6/2020 |
| EP | 3 666 685 | A1 | 6/2020 |
| ES | 2159235 | | 9/2001 |
| FR | 2 737 196 | A1 | 1/1997 |
| GB | 1 256 684 | | 12/1971 |
| GB | 2 221 666 | A | 2/1990 |
| GB | 2 321 229 | A | 7/1998 |
| GB | 9006736716 | | 8/2019 |
| GB | 2591535 | A | 8/2021 |
| GB | 6161591 | | 9/2021 |
| JP | 37-15730 | | 9/1960 |
| JP | 10-194330 | A | 7/1998 |
| JP | 10-297668 | A | 11/1998 |
| JP | 11-193059 | | 7/1999 |
| JP | 2001-519300 | A | 10/2001 |
| JP | 2003-146359 | | 5/2003 |
| JP | 2004-189243 | A | 7/2004 |
| JP | 4077790 | | 2/2008 |
| JP | 2015-048088 | A | 3/2015 |
| JP | 2016-124605 | | 7/2016 |
| KR | 10-2005-0051616 | A | 6/2005 |
| KR | 10-2020-0106806 | A | 9/2020 |
| KR | 301130233 | | 10/2021 |
| NZ | 573592 | A | 10/2011 |
| NZ | 721794 | A | 4/2019 |
| WO | WO 91/05716 | A1 | 5/1991 |
| WO | WO 93/02941 | | 2/1993 |
| WO | WO 93/21083 | | 10/1993 |
| WO | WO 93/25439 | A1 | 12/1993 |
| WO | WO 94/22738 | A1 | 10/1994 |
| WO | WO 95/01289 | A1 | 1/1995 |
| WO | WO 95/06604 | | 3/1995 |
| WO | WO 95/10459 | A1 | 4/1995 |
| WO | WO 95/22495 | A1 | 8/1995 |
| WO | WO D036442-002 | | 7/1996 |
| WO | WO 96/26128 | A1 | 8/1996 |
| WO | WO 96/32340 | A1 | 10/1996 |
| WO | WO 03/016167 | A1 | 2/2003 |
| WO | WO 2006/044583 | A2 | 4/2006 |
| WO | WO 2008/058294 | A1 | 5/2008 |
| WO | W0 2009/023822 | A1 | 2/2009 |
| WO | WO 2010/006629 | A1 | 1/2010 |
| WO | WO 2010/101852 | A1 | 9/2010 |
| WO | W0 2016/008744 | A1 | 1/2016 |
| WO | WO 2016/100010 | A1 | 6/2016 |
| WO | WO 2016/112145 | A1 | 7/2016 |
| WO | WO 2020/210562 | A1 | 10/2020 |
| WO | WO 2021/038516 | A1 | 3/2021 |
| WO | WO 2021/168417 | A1 | 8/2021 |
| WO | WO 2021/188751 | A1 | 9/2021 |
| WO | WO 2021/262858 | A1 | 12/2021 |

OTHER PUBLICATIONS

"Pepsi trials molded pulp alternative to plastic rings" in BeverageDaily.com. Date posted: Feb. 28, 2020. Site visited: Sep. 12, 2022. Available online: https://www.beveragedaily.com/Article/2020/02/28/Pepsi-trials-molded-pulp-alternative-to-plastic-rings# (Year: 2020).

Enviroclip. Date posted: 2022. Site visited: Sep. 12, 2022. Available online: https://www.graphicpkg.com/products/enviroclip/ (Year: 2022).

"Paperboard Can Handle Applicator," as seen in Packaging World Online. Date first available: 2020. Site visited: Sep. 13, 2022. Available online: https://www.packworld.com/news/sustainability/article/21202650/paperboard-can-handle-applicator (Year: 2020).

"The 'ECOGRIP' Corrugated Bottle Carrier is a Plastic Alternative" in Trendhunter.com. Date published: Jan. 20, 2021. Site visited: Sep. 12, 2022. Available online: https://www.trendhunter.com/trends/corrugated-bottle-carrier (Year: 2021).

Cap-it packaging video on Vimeo. Date posted: 2021. Site visited: Sep. 19, 2022. Available online: https://vimeo.com/610619455?embedded=true&source=vimeo_logo&owner=24551687 (Year: 2021).

2020 Package of the Year and Innovation of the Year on YouTube. Date posted: Oct. 19, 2020. Site visited: Sep. 12, 2022. Available online: https://www.youtube.com/watch?v=wxwpM4hodFA (Year: 2020).

International Search Report and Written Opinion for PCT/US2022/032608 dated Sep. 28, 2022.

International Search Report and Written Opinion for PCT/US2022/035207 dated Oct. 14, 2022.

International Search Report and Written Opinion for PCT/US2022/034840 dated Oct. 21, 2022.

International Search Report and Written Opinion for PCT/US2022/036297 dated Oct. 21, 2022.

International Search Report and Written Opinion for PCT/US2022/037069 dated Oct. 28, 2022.

International Search Report and Written Opinion for PCT/US2022/037071 dated Nov. 2, 2022.

6 Pack Cardboard Carrier_Beer Carriers_Pak-It Products, [date first available: Dec. 9, 2021], [date found online: Jun. 10, 2024], https:/www.pakitproducts.com/product/recyclable-6-pak-cardboard-can-carrier/ (Year: 2021).

Introducing Fishbone Recyclable Can Carrier System_Atlantic Packaging, [date first available: December 7, 20202], [date found online: Jun. 11, 2024], https://www.atlanticpkg.com/2020/12/introducing-fishbone-recyclable-can-carrier-system/ (Year: 2020).

WestRock Company_YouTube, [date first posted: Jul. 22, 2020], [date found online: Jun. 12, 2024], https://www.youtube.com/watch?v=LAq-uYiU2UE (Year: 2020).

Asahi Breweries First Japanese User of WestRock Cancollar® Eco Packaging, [date first posted: Oct. 15, 2021], [date found online: Jun. 12, 2024], https://www.asahibeer.com.jp/news/2021/1015_2.html (Year 2021).

Smurtfit Kappa GreenClip_Facebook, [date first posted: Dec. 7, 2020], [date found online: Jun. 12, 2024], https://www.facebook.com/SmurfitKappaGroup/videos/smurfit-kappa-greenclip/410973346931978/ (Year: 2020).

(56) References Cited

OTHER PUBLICATIONS

Smurfit Kappa and KHS Join Forces for TopClip Solution_ ThePackagingPortal.com, [date first available: Nov. 19, 2020], [date found online: Jun. 24, 2024], https://www.thepackagingportal.com/industry-news/smurfit-kappa-and-khs-join-forces-for-topclip-solution (Year: 2021).
International Search Report and Written Opinion for PCT/US2022/038638 dated Nov. 8, 2022.
Notice of Reasons for Refusal for Japanese Patent Application No. 2024-505477 dated May 13, 2025, with translation.
Extended European Search Report for European Patent Application No. 22838371.7 dated Apr. 28, 2025.
Extended European Search Report for European Patent Application No. 22850303.3 dated May 27, 2025.
Extended European Search Report for European Patent Application No. 22829357.7 dated Jun. 3, 2025.

* cited by examiner

CARRIER FOR CONTAINERS

CROSS-REFERENCE TO RELATED APPLICATION

This application claims the benefit of U.S. Provisional Patent Application No. 63/203,724, filed on Jul. 29, 2021.

INCORPORATION BY REFERENCE

The disclosures of each of U.S. Provisional Patent Application No. 63/203,724, filed on Jul. 29, 2021, and U.S. Design patent application Ser. No. 29/838,187, filed on May 11, 2022, are hereby incorporated by reference for all purposes as if presented herein in their entirety.

BACKGROUND OF THE DISCLOSURE

The present disclosure generally relates to carriers or cartons for holding and carrying containers.

SUMMARY OF THE DISCLOSURE

According to one aspect, the disclosure is generally directed to a carrier for holding a plurality of containers, the carrier comprising a central panel and container retention features for engaging the plurality of containers, the container retention features include a plurality of container retention openings for at least partially receiving a respective container of the plurality of containers, at least one container retention tab positioned extending into a respective container retention opening for engaging a respective container of the plurality of containers, and at least one edge retainer extending from a respective container retention tab of the plurality of container retention tabs and for facilitating engagement of the carrier with the plurality of containers.

According to another aspect, the disclosure is generally directed to a blank for forming a carrier for holding a plurality of containers, the blank comprising a central panel and container retention features for engaging the plurality of containers when the carrier is formed from the blank, the container retention features include a plurality of container retention openings for at least partially receiving a respective container of the plurality of containers, at least one container retention tab positioned extending into a respective container retention opening for engaging a respective container of the plurality of containers, and at least one edge retainer extending from a respective container retention tab of the plurality of container retention tabs and for facilitating engagement of the carrier with the plurality of containers when the carrier is formed from the blank.

According to another aspect, the disclosure is generally directed to a method of forming a carrier for holding a plurality of containers, the method comprising obtaining a blank comprising a central panel and container retention features, the container retention features include a plurality of container retention openings, at least one container retention tab positioned extending into a respective container retention, and at least one edge retainer extending from a respective container retention tab of the plurality of container retention tabs. The method further comprises positioning the blank such that the plurality of container retention openings is positioned for at least partially receiving a respective container of the plurality of containers, such that the at least one container retention tab is positioned for engaging a respective container of the plurality of containers, and such that the at least one edge retainer is positioned for facilitating engagement of the carrier with the plurality of containers.

According to another aspect, the disclosure is generally directed to a package, the package comprising a plurality of containers and a carrier holding the plurality of containers. The carrier comprises a central panel and container retention features engaging the plurality of containers, the container retention features include a plurality of container retention openings at least partially receiving a respective container of the plurality of containers, at least one container retention tab positioned extending into a respective container retention opening engaging a respective container of the plurality of containers, and at least one edge retainer extending from a respective container retention tab of the plurality of container retention tabs and facilitating engagement of the carrier with the plurality of containers.

Those skilled in the art will appreciate the above stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION

The present disclosure generally relates to constructs, sleeves, cartons, or the like, and packages for holding and displaying containers such as cans, jars, bottles, etc. The containers can be used for packaging food and beverage products, for example. The containers can be made from materials suitable in composition for packaging the particular food or beverage item, and the materials include, but are not limited to, aluminum and/or other metals, plastics such as PET, LDPE, LLDPE, HDPE, PP, PS, PVC, EVOH, and Nylon; and the like; glass; or any combination thereof.

Packages according to the present disclosure can accommodate containers of numerous different shapes. For the purpose of illustration and not for the purpose of limiting the scope of the disclosure, the following detailed description describes beverage containers (e.g., generally cylindrical containers such as aluminum cans) at least partially disposed within the package embodiments. In this specification, the terms "lower," "bottom," "upper" and "top" indicate orientations determined in relation to fully erected packages.

Figure 1:
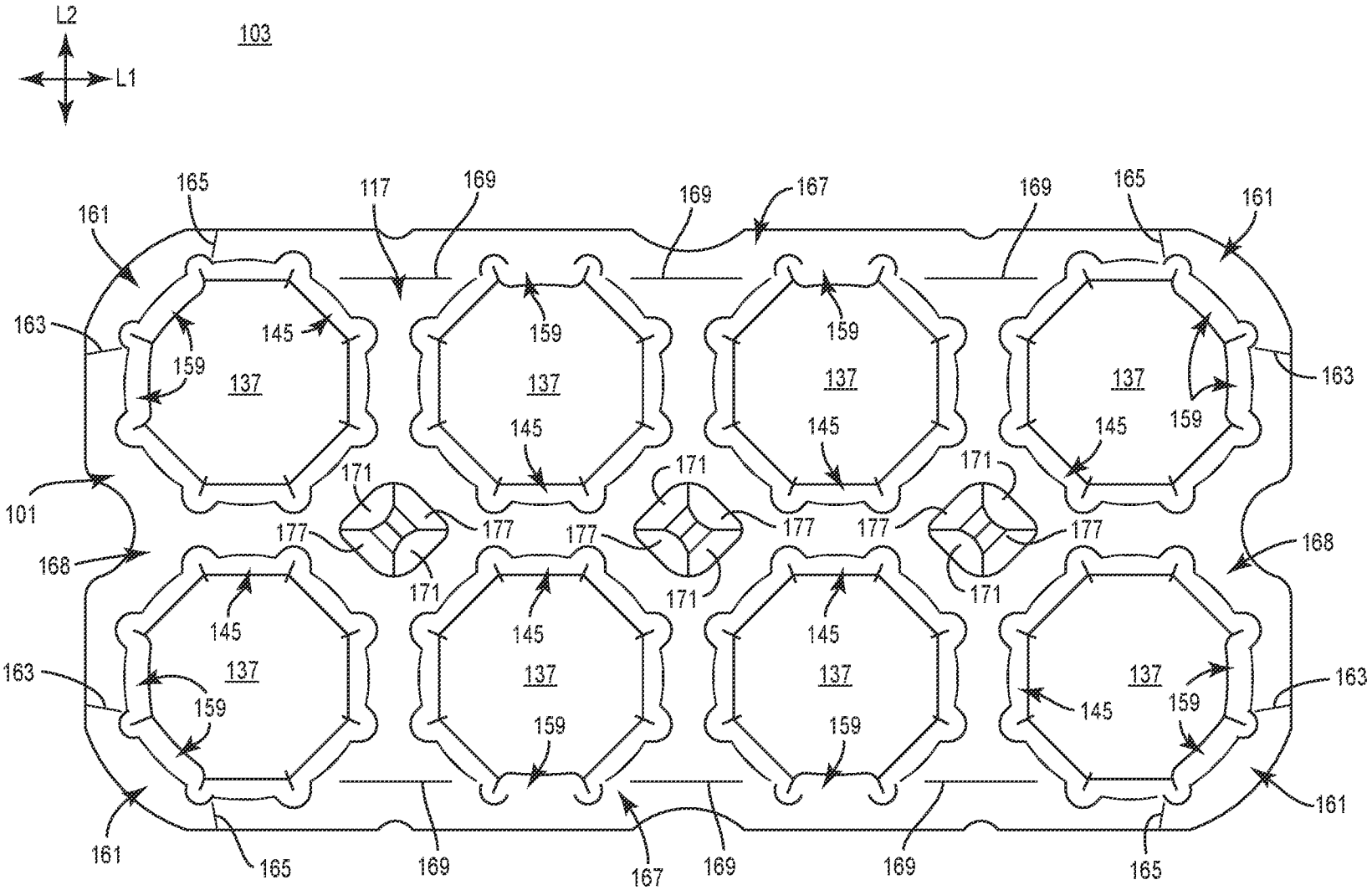
FIG. 1 is a plan view of a container retention blank for forming a package and carrier according to a first exemplary embodiment of the disclosure.

FIG. 1 is a plan view of an exterior surface 101 of a blank 103 for forming a carrier 105 (FIG. 2) according to a first exemplary embodiment of the disclosure. As described further herein, the carrier 105 can be configured for holding/supporting/retaining/receiving a plurality of containers C. The carrier 105 can be provided with one or more containers C to form a package 107 (FIG. 2).

Figure 2:
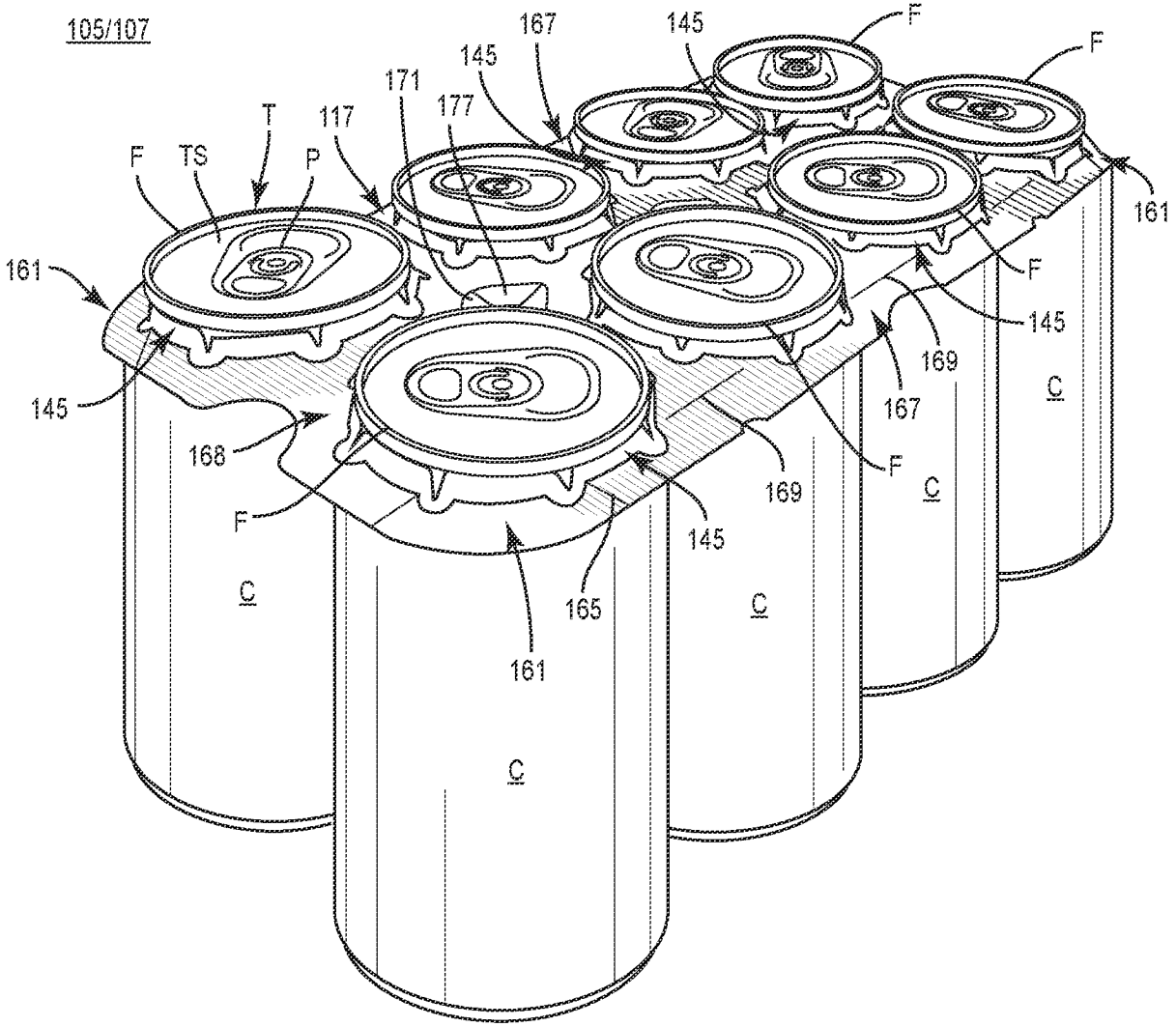
FIG. 2 is a perspective view of a package and carrier formed from the blank of FIG. 1 according to the first exemplary embodiment.
Figure 3:
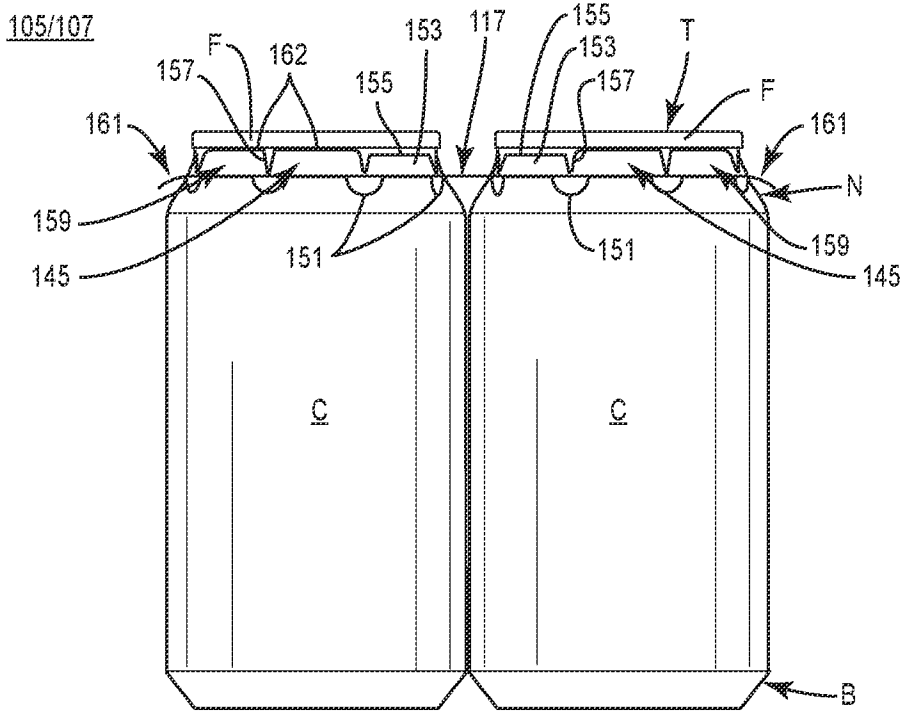
FIG. 3 is a side elevation view of the package and carrier of FIG. 2.

Referring momentarily to FIGS. 2 and 3, containers C for use with the carriers of the present disclosure are illustrated as beverage containers having a lower base portion B, a top portion T generally comprising a neck N that tapers inwardly from the lower base portion, a flange portion F at the top of the neck portion that extends radially outward from the neck portion, and a top surface TS below the flange portion that includes a pull-tab P. Containers of other sizes, shapes, and configurations, may be held in the carriers without departing from the disclosure.

Still referring to FIG. 1, the blank 103 has a longitudinal axis L1 and a lateral axis L2. The blank 103 comprises an attachment panel or central panel 117 that includes container retention features for engaging containers C when the carrier 105 is formed from the blank 103. In the illustrated embodiment, the container retention features include eight container retention openings 137 in the central panel 117.

Figure 1A:
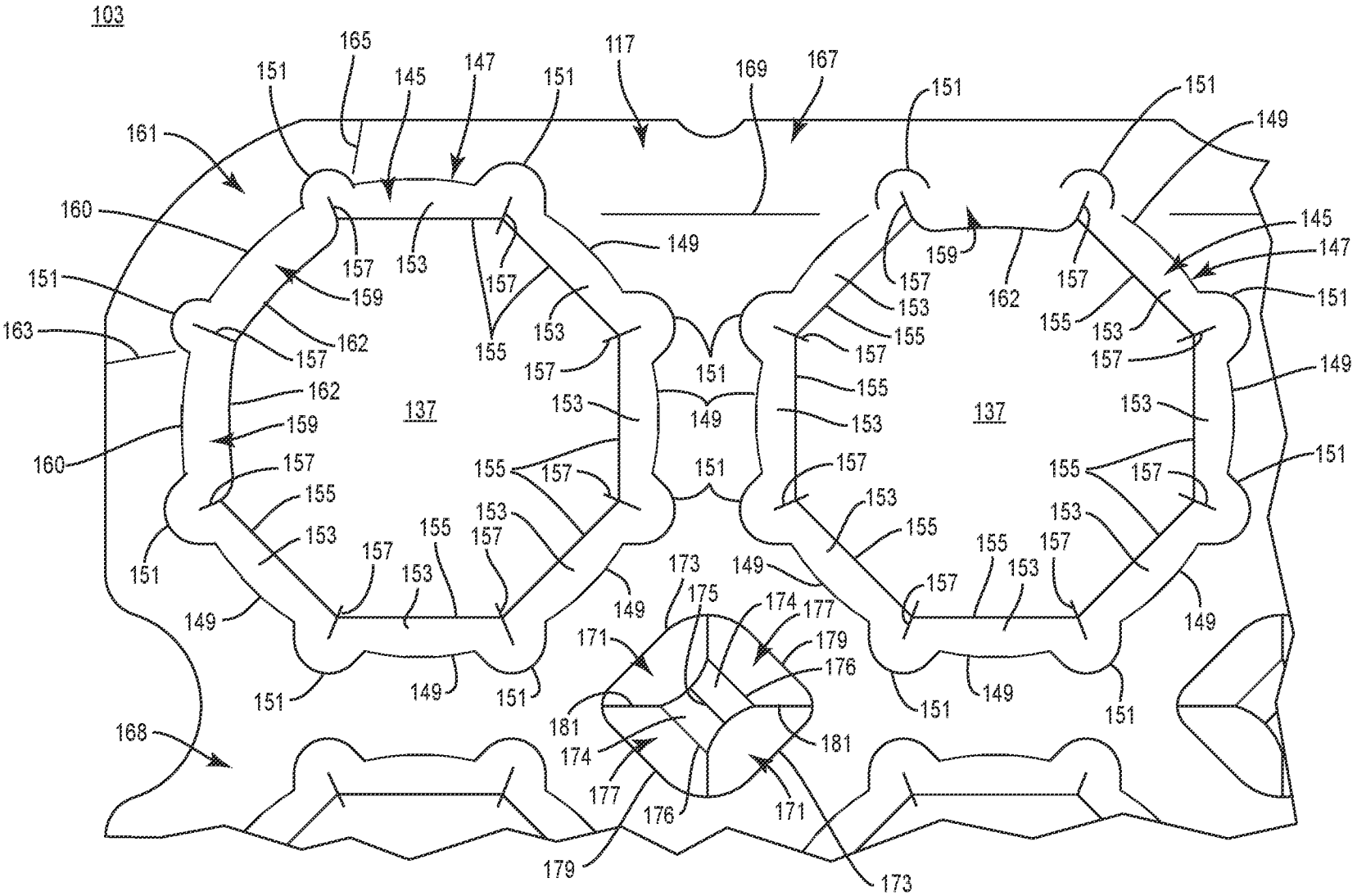
FIG. 1A is an enlarged view of a portion of the blank of FIG. 1.

With additional reference to the enlarged view of FIG. 1A, the container retention features can also include respective container retention tabs 145 (broadly, "first container retention tabs") foldably attached to the central panel 117 at a respective fold line/line of weakening 147 and circumferentially arranged to extend into the respective container retention openings 137. The line of weakening 147, as shown, can include an alternating sequence of relatively elongate curved fold line segments and relatively short curved cuts 151.

As shown, each container retention tab 145 is a generally continuous member having a plurality of container retention sections 153 each defining a container retention edge 155 facing the respective container retention openings 137.

As also shown, the container retention sections 153 can be generally continuous at least partially separated from one another at respective oblique lines of weakening 157 that extend from the respective container retention edges 155 at least partially along the respective container retention tabs 145. In the illustrated embodiment, the relatively elongate curved fold line segments 149 can be generally circumferentially aligned with the respective container retention sections 153, and the relatively short curved cuts 151 can be generally circumferentially aligned with the respective oblique lines of weakening 157.

As also shown, a pair of container retention tabs 159 (broadly, "second container retention tabs") can interrupt the container retention tabs 145 surrounding the container retention openings 137 adjacent the corners of the central panel 117. The container retention tabs 159, as shown, can extend further into the respective container retention openings 137 than the respective container retention tabs 145 so as to define container retention edges 162 that protrude past the container retention edges 155 of the container retention sections 153 of the container retention tabs 145. The container retention tabs 159 can be separated from each other and from adjacent container retention sections 153 at respective oblique lines of weakening 157. In some embodiments, the container retention tabs 159 can be at least partially separable from the central panel 117 at respective portions of one or more of the curved cuts 151 associated with respective adjacent container retention sections 153 of the container retention tabs 145. In some embodiments, the container retention tabs 159 can extend at least partially uninterruptedly from the central panel 117, and in other embodiments, the container retention tabs 159 can be foldably connected to the central panel 117 at respective fold lines 160.

With continued reference to FIGS. 1 and 1A, a container retention tab 159 can also interrupt the container retention tabs 145 other than those adjacent the corners of the central panel 117, and such that the respective container retention tab 159 extends into the container retention openings 137 adjacent the container retention openings 137 near the corners of the central panel 117. These container retention tabs 159 can be devoid of foldable connection to the central panel 117, though may be foldably connected to the central panel 117 without departing from the disclosure.

As also shown, container retention features of the blank 103/central panel 117/carrier 105 can include edge retainers of the central panel 117 to facilitate engagement with respective containers of the plurality of containers. Corner edge retainers 161 can be positioned at respective corner portions of the central panel 117, and can be foldably attached to the remainder of the central panel 117 at respective oblique fold lines 163, 165. In this regard, the corner edge retainers can include/be associated with at least a portion of a respective container retention tab 159 positioned adjacent the corners of the central panel 117. For example, the corner edge retainers 161 intersect and extend away from the respective container retention tabs 159.

The container retention features of the blank 103/central panel 117/carrier 105 can also include longitudinal edge retainers 167 foldably connected to the remainder of the central panel at respective longitudinal fold lines 169 that are interrupted by container retention tabs 145 extending into the container retention openings 137 adjacent the respective corners of the central panel 117, and that are interrupted by respective container retention tabs 159 extending into the container retention openings 137 between those positioned adjacent the respective corners of the central panel 117. The longitudinal edge retainers 167 can also thus be foldably connected to adjacent corner edge retainers 161 at respective oblique fold lines 165. Further, the longitudinal edge retainers 167 can intersect and extend from the respective container retention tabs 145, 159.

Still further, the container retention features of the blank 103/central panel 117/carrier 105 can include lateral edge retainers 168 defined at least partially between respective fold lines 163 so as to be foldably connected to respective corner edges retainers 161 at the respective fold lines 163. In this regard, the lateral edge retainers 168 are arranged so as to intersect and extend away from respective portions of respective container retention tabs 159, 145. As described further herein, the lateral edge retainers 168 can facilitate engagement of the carrier 105 with the containers C.

It will be understood that one or more of the container retention features of the blank 103/central panel 117/carrier 105 can be provided in a different number, arrangement, and/or configuration without departing from the disclosure.

Still referring to FIGS. 1 and 1A, the blank 103/carrier 105 can include handle features for lifting/carrying/moving the carrier 105. As shown, the handle features can include a pair of handle flaps 171 foldably connected to the central panel 117 at respective oblique fold lines 173 and separated from one another, with an oblique cut 175 extending from one handle flap 171 to the other handle flap 171. The handle features can also include a pair of handle flaps 177 foldably connected to the central panel 117 at respective oblique fold lines 179 and separated from the handle flaps 171 at respective curved cuts 181 that intersect the oblique cut 175.

As shown, each handle flap 177 can have an associated handle reinforcement flap 174 foldably connected thereto at a respective oblique fold line 176 such that the handle reinforcement flaps 174 are separated at the cut 175 and from the handle flaps 171 at the respective cuts 181. As described further herein, the handle reinforcement flaps 174 can be configured to engage the geometry of the containers C to provide reinforcement to the carrier 105/package 107.

Still referring to FIGS. 1 and 1A, and referring additionally to FIGS. 2 and 3, in one embodiment, a method of forming a package 107 that includes the carrier 105 and one or more of the containers C comprises obtaining the blank 103 and obtaining the group of containers C (e.g., eight containers, with four containers C in each of two rows, but more or less than eight containers can be included in the package). The blank 103 can be positioned on top of the group of containers C and the central panel 117 of the blank 103 can be pushed downward so that the flanges F of the containers C are inserted through a respective opening 137. After pressing the blank 103/central panel 117 downward onto the containers C, the retention container retention tabs 145 can be urged to fold upwardly at the respective fold lines 147 and the container retention tabs 159 can be urged to fold upwardly at the respective fold lines 160.

Such movement of the container retention tabs 145, 159 can cause the container retention sections 153 to separate from one another and/or from adjacent container retention tabs 159 at the respective lines of weakening 157 such that the container retention sections 153/container retention tabs 159 are positioned to extend toward respective containers C and position the respective container retention edges 155, 161 to contact a respective container C at the neck portion N thereof below a respective flange F. Such upward/oblique arrangement of the container retention sections 153/container retention tabs 159 extending from the central panel 117 to a top structure of the respective containers C can provide a reinforced, braced, stabilized, etc., engagement of the top container retention blank 103/central panel 117/carrier 105 with the containers C.

Furthermore, the arrangement of the container retention sections 153/container retention tabs 159/lines of weakening 157 are such that one or more of the container retention sections 153/container retention tabs 159 can at least partially overlap, e.g., by bunching, buckling, sliding past one another, etc., so as to provide additional forces between the central panel 117 and the containers C to provide further reinforcement and securement of the containers C to the central panel 117. In some embodiments, the cuts 151 can provide stress relieving regions/clearance to the tabs 145 in the course of engagement with a respective container C.

With continued reference to FIGS. 2 and 3, the corner edge retainers 161 can be folded at least partially downwardly and inwardly at the respective oblique fold lines 163, 165 to urge the respective container retention tabs 159 associated therewith into a closer/clamping engagement with the neck portion of the respective containers C extending through the container retention openings 137 adjacent the respective corners of the central panel 117. Such an arrangement can position the corner edge retainers 161 in a generally oblique arrangement with the remainder of the central panel 117.

Similarly, the longitudinal edge retainers 167 can be folded downwardly at the respective longitudinal fold lines 169 and/or at least partially inwardly at the respective oblique fold lines 165 to urge the respective adjacent container retention tabs 159 into a closer/clamping engagement with the neck portion of the respective containers C adjacent therewith.

The aforementioned adjustment of the container retention features of the carrier 105 can cause the lateral edge retainers 168 to at least partially move relative to the corner edge retainers 161, e.g., via folding at the respective fold lines 163, into a downward oblique arrangement with the remainder of the central panel 117, for example, to facilitate movement of the other container retention features of the carrier 105 and/or to urge respective container retention tabs 159, 145 in to a closer/clamping engagement with the neck portion of a respective container C.

Upon formation of the package 107/carrier 105, a customer or other user can engage the package 107/105 by inserting one or more of his or her fingers against the respective handle flaps 171, 177 to cause the respective handle flap 171, 177 to fold downwardly at a respective fold line 173, 179 to create an opening or space through which one or more finger can be inserted to engage the underside of the central panel 117 to lift, carry, or otherwise move/manipulate the package 107/carrier 105. During such engagement of the package 107/carrier 105, one or more of the handle flaps 171, 177 can be positioned between the finger(s) of the user/customer and the central panel 117, e.g., for comfort, to avoid pinching, to more evenly distribute stresses across the package 107/carrier 105, etc.

In some embodiments, one or both of the handle reinforcement flaps 174 can fold at the respective fold line 176 into at least partial face-to-face contact with the underside of the central panel 117 such that both the handle flaps 177 and handle reinforcement flaps 174 can be positioned between a user's finger and the central panel 117. Relative folding of the handle reinforcement flap 174 at the respective fold line 176 can assist in camming or otherwise transitioning the respective handle reinforcement flap 174 over the neck portion N of a respective container C and into at least partial face-to-face contact with the central panel 117. In one embodiment, a respective distal free edge of the handle reinforcement flaps 174 can be spaced apart from a respective adjacent fold line segment 149 such that the respective handle reinforcement flap 174 is positioned generally above the neck portion N of a respective container C to provide an extra layer of material between the user's finger(s) and the central panel 117, e.g., for the comfort of the user (so as to avoid pinching) and/or to more evenly distribute stresses along the central panel 117 in proximity to the handle features.

Furthermore, the handle features of the package 107/carrier 105 can be such that a user can insert his or her finger(s) therethrough in a variety of orientations, e.g., 360° of orientations, in order to effect grasping or other engagement of the package 107/carrier 105, and can minimize tearing or other stresses across the central panel 117 incidental to such engagement of the handle features of the package 107/carrier 105.

Figure 4:
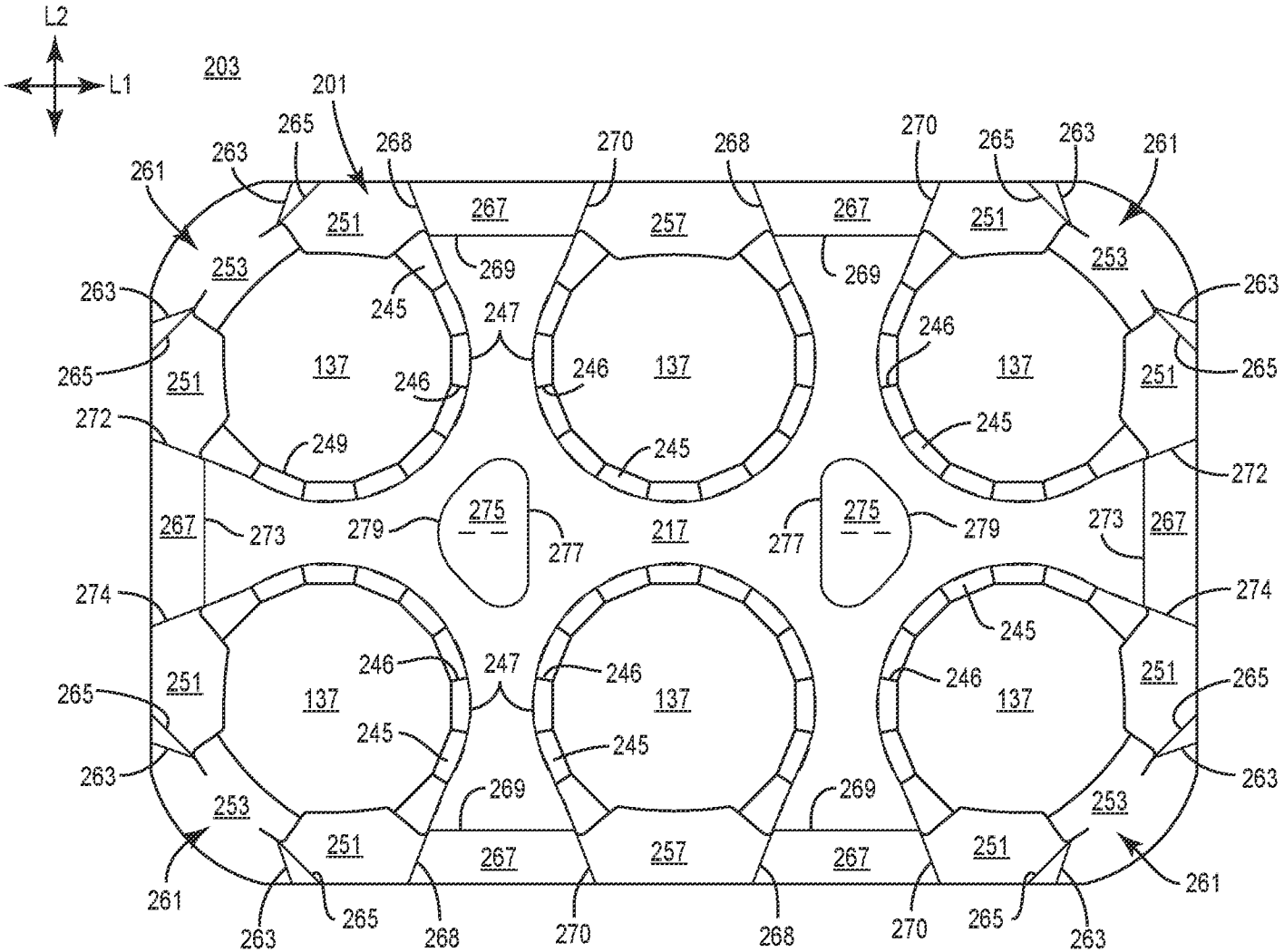
FIG. 4 is a plan view of a container retention blank for forming a package and carrier according to a second exemplary embodiment of the disclosure.
Figure 5:
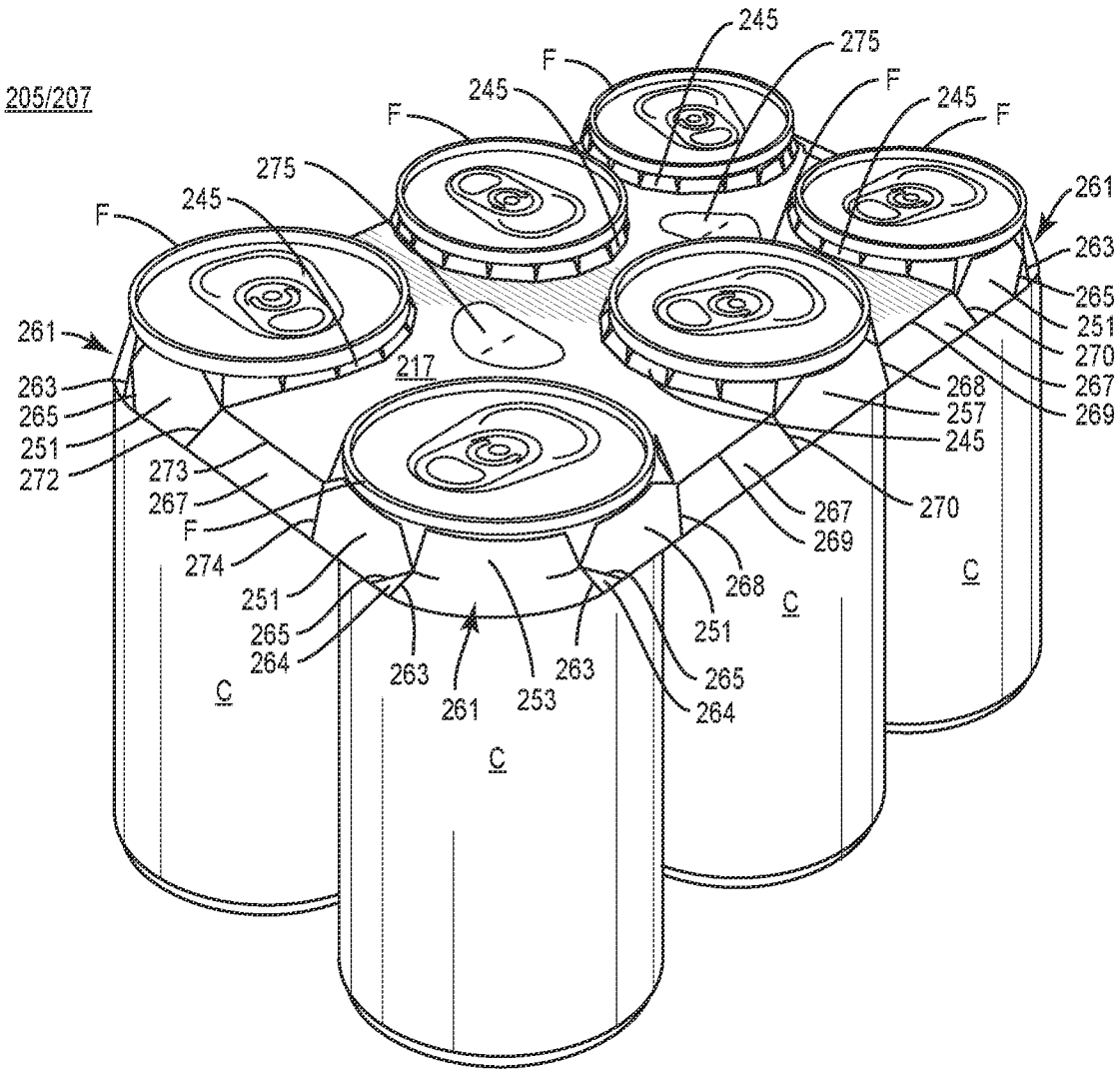
FIG. 5 is a perspective view of a package and carrier formed from the blank of FIG. 4 according to the second exemplary embodiment.

Referring to FIG. 4, an exterior surface 201 of a blank 203 for forming a carrier 205 (FIG. 5) according to a second exemplary embodiment of the disclosure is illustrated. The blank 203/carrier 205 can have one or more features that are the same or similar to the blank 103/carrier 105 of the first exemplary embodiment, and like or similar features are provided with like or similar reference numerals. The carrier 205 can be provided with one or more of the containers C to form a package 207 (FIG. 5).

As shown, the blank 203 has the longitudinal axis L1 and the lateral axis L2, and includes an attachment panel or central panel 217 that includes container retention features for engaging containers C when the carrier 205 is formed from the blank 203. In the illustrated embodiment, the container retention features include six container retention openings 137 in the central panel 117.

Figure 4A:
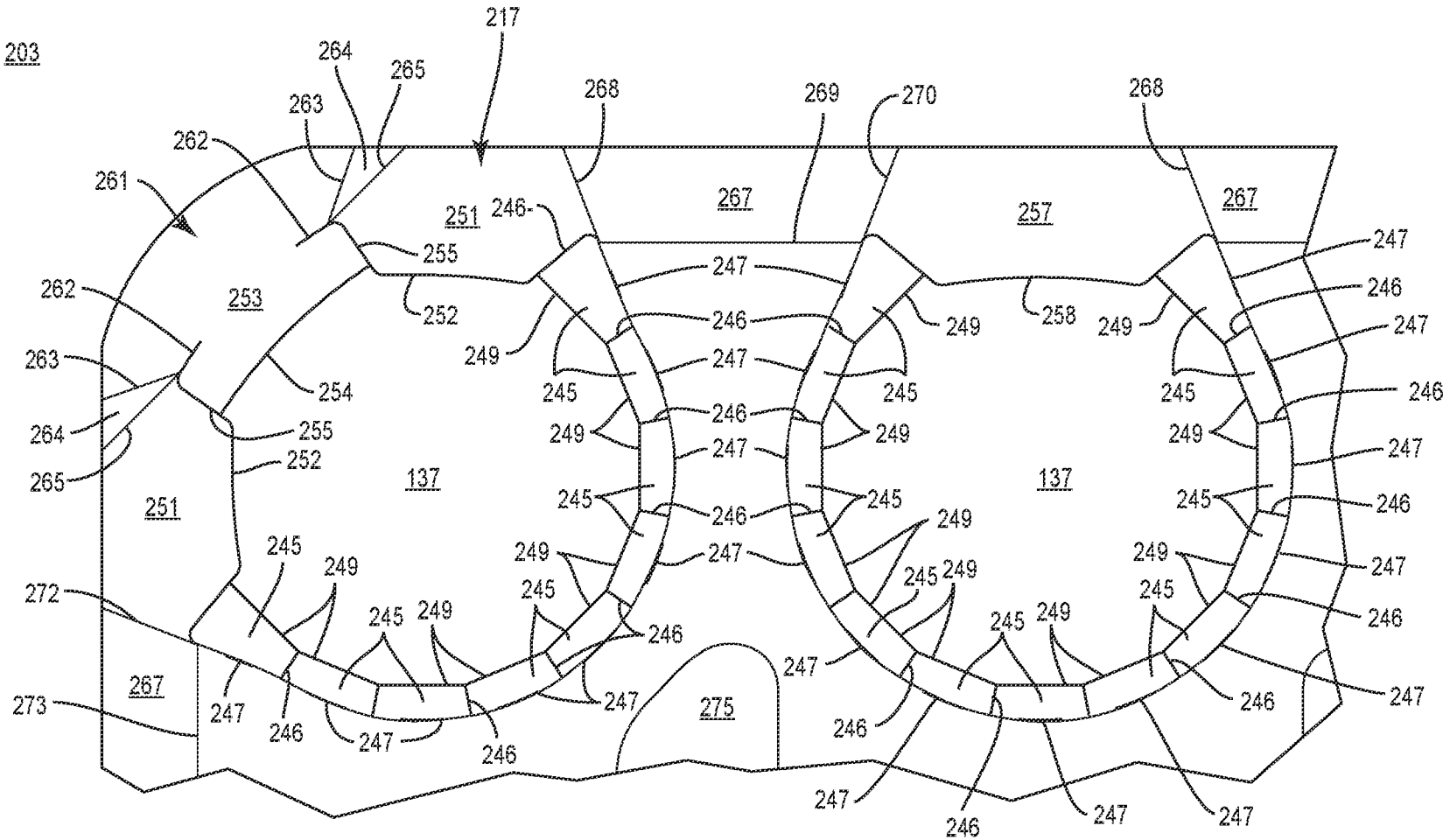
FIG. 4A is an enlarged view of a portion of the blank of FIG. 4.

With additional reference to the enlarged view of FIG. 4A, the container retention features can also include a plurality of container retention tabs 245 foldably attached to the central panel 217 at respective fold lines 247 and circumferentially arranged to extend into the respective container retention openings 137 to present container retention edges 249 along the openings 137. In the illustrated embodiment, the container retention tabs 245 can be positioned in generally abutting relation and separated from one another at cut lines 246. In one embodiment, one or more pairs of adjacent container retention tabs 245 can be spaced apart from one another.

While the container retention tabs 245 are illustrated as generally trapezoidal elements with their wider end foldably attached to the central panel 217, it will be understood that the shape and geometry of the container retention openings 137 and/or the container retention tabs 245 or of other/additional container retention features of the blank 203/carrier 205, could vary to increase the retention forces applied to the container C and/or to accommodate various sizes and configurations of containers, without departing from the scope of the disclosure.

At least one container retention tab 253 can be positioned between container retention tabs 245 and extending into a respective portion of the respective opening 137, as described further herein. The container retention tabs 253 can define respective container retention edges 254 for engaging respective containers.

As also shown, container retention features of the blank 203/central panel 217/carrier 205 can include edge retainers of the central panel 117. Corner edge retainers 261 can be positioned at respective corner portions of the central panel 217 at least partially intersecting and extending away from respective container retention tabs 253. In the illustrated embodiment, the container retention tab 253 can be at least partially separable from the corner edge retainer 261 at respective cuts 262 so as to be separably/foldably connected to the corner edge retainer 261.

The container retention features of the blank 203/central panel 217/carrier 205 can also include longitudinal edge retainers 251, 267, 257 for engaging respective containers C and/or facilitating engagement of the carrier 105 with respective containers C.

In the illustrated embodiment, a longitudinal edge retainer 251 can be positioned extending into respective container retention openings 137 and defining a container retention edge 252 therealong for engaging a respective container C. As shown, the container retention edges 252 can extend further into the respective openings 137 than the container retention edges 254 of the container retention tabs 253 and/or the container retention edges 249 of the container retention tabs 245. Each longitudinal edge retainer 251 can be foldably connected to an adjacent longitudinal edge retainer 267 at a respective oblique fold line 268. The longitudinal edge retainers 251 can also be separable from adjacent container retention tabs 253 at respective cuts 255. In this regard, the edge retainers 251 are positioned intersecting and extending away from respective container retention tabs 253, 249.

As shown, respective reconfigurable portions 264 can be defined between respective oblique fold lines 263, 265 such that each reconfigurable portion is foldably connected to a respective adjacent corner edge retainer 261 at a respective oblique fold line 263 and to a respective adjacent longitudinal edge retainer 251 at a respective oblique fold line 265.

The longitudinal edge retainers 267 can be foldably connected to the central panel 217 at a respective longitudinal fold line 269 with endpoints that intersect respective fold lines 247. Each longitudinal edge retainer 267 is foldably connected to an adjacent longitudinal edge retainer 257 at a respective oblique fold line 270. In some embodiments, the longitudinal edge retainers 267 can be positioned intersecting and extending away from respective container retention tabs 245.

The longitudinal edge retainers 257 can be positioned extending into respective container retention openings 137 and defining a respective retention edges 258 therealong for engaging a respective container C. As shown, the respective retention edges 258 of the respective longitudinal edge retainers 257 can extend further into the respective openings 137 than the respective retention edges 249 of the respective container retention tabs 245. Each longitudinal edge retainer 257 can be positioned between and foldably connected to a respective pair of longitudinal edge retainers 267 such that each longitudinal edge retainer 257 is foldably connected to one adjacent longitudinal edge retainer 267 at the respective oblique fold line 270, and to the other adjacent longitudinal edge retainer 267 at a respective oblique fold line 268. As shown, the longitudinal edge retainers 257 can be positioned intersecting and extending away from respective container retention tabs 245.

Container retention features of the blank 203/carrier 205 can also include lateral edge retainers 251 having a generally similar configuration to the longitudinal edge retainers 251 described above, and lateral edge retainers 267 having a configuration generally similar to the longitudinal edge retainers 267 described above. The lateral edge retainers 267 can be foldably connected to the central panel 217 at respective lateral fold lines 273. In some embodiments, the lateral edge retainers 267 can be positioned intersecting and extending away from respective container retention tabs 245.

In this regard, the lateral edge retainers 267 can be positioned between and attached to adjacent lateral edge retainers 251 at respective oblique fold lines 272, 274. Furthermore, respective reconfigurable portions 264 can be defined between respective oblique fold lines 263, 265 such that reconfigurable portions 264 are foldably connected to a respective adjacent corner edge retainer 261 at a respective oblique fold line 263 and to a respective adjacent lateral edge retainer 251 at a respective oblique fold line 265. As described further herein, the lateral edge retainers 251, 257, 267 can facilitate engagement of the carrier 205 with the containers C.

It will be understood that one or more of the container retention features of the blank 203/central panel 217/carrier 205 can be provided in a different number, arrangement, and/or configuration without departing from the disclosure.

Still referring to FIGS. 4 and 4A, the blank 203/carrier 205 can include handle features for lifting/carrying/moving the carrier 205. As shown, the handle features can include a pair of handle reinforcement flaps 275 foldably connected to the central panel 217 at respective lateral fold lines 277 and at least partially defined by respective curved cuts 279.

Figure 6:
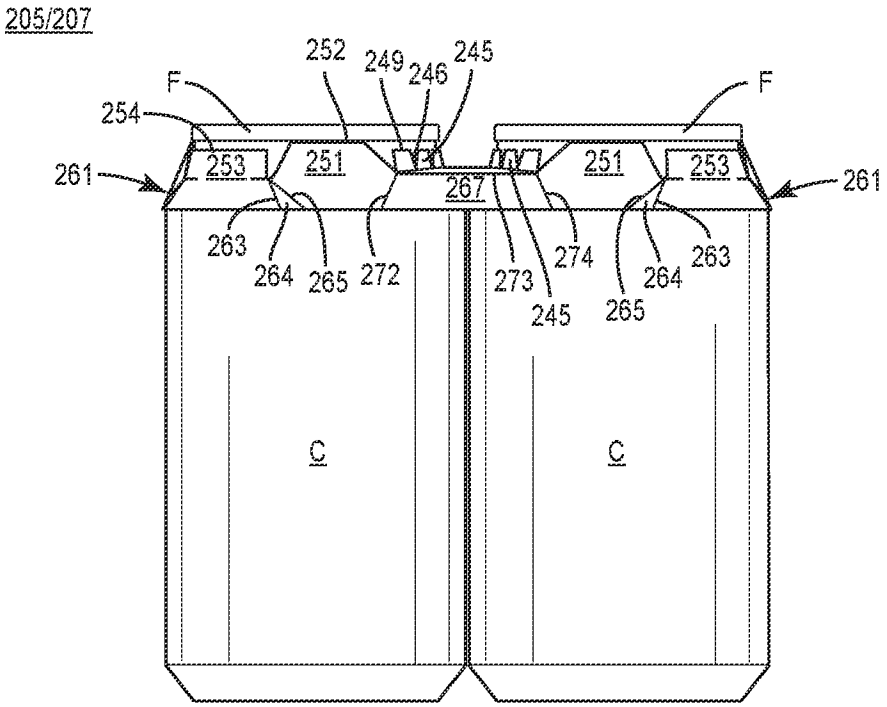
FIG. 6 is a side elevation view of the package and carrier of FIG. 5.

Referring additionally to FIGS. 5 and 6, in one embodiment, a method of forming a package 207 that includes the carrier 205 and one or more of the containers C comprises obtaining the blank 203 and obtaining the group of containers C (e.g., six containers, with three containers in each of two rows, but more or less than six containers can be included in the package).

The blank 203 can be positioned on top of the group of containers C and the central panel 217 of the blank 203 can be pushed downward so that the flanges F of the containers C are inserted through a respective opening 137. After pressing the blank 203/central panel 217 downward onto the containers C, the retention container retention tabs 245 can be urged to fold upwardly at the respective fold lines 247 and the container retention tabs 253 can be urged to flex/bend upwardly at the respective cuts 262.

Furthermore, the respective edge retainers 251, 257 can be urged into a generally oblique arrangement with the central panel 217 such that the respective container retention edges 252, 258 extend into engagement with the respective containers C, e.g., so as to contact a respective container C at the neck portion thereof below a respective flange F. Such movement of the edge retainers 251, 257 can include relative movement/folding at one or more of the respective fold lines 265, 268, 270.

Such movement of the container retention tabs 245, 253 and edge retainers 251, 257 can position the respective container retention edges 249, 254, 252, 258 to contact a respective container C at the neck portion thereof below a respective flange F. Such upward/oblique arrangement of the container retention tabs 245, 253 and edge retainers 251, 257 extending to a top structure of the respective containers C can provide a reinforced, braced, stabilized, etc. engagement of the top container retention blank 203/central panel 217/carrier 205 with the containers C.

Such movement of the container retentions tabs 245, 253 and edge retainers 251, 257 can cause one or more of the edge retainers 261, 267 and/or reconfigurable portions 264 to fold downwardly and/or inwardly at respective fold lines 263, 268, 270, 272, 274, 265 to facilitate the aforementioned engagement of the respective container retention tabs 245, 253 and edge retainers 251, 257 with the respective containers C, e.g., by urging one or more of the respective adjacent container retention tabs 251, 253 into a closer closer/clamping engagement with the neck portion of the respective containers C adjacent therewith.

Furthermore, the generally obliquely downward arrangement of respective edge retainers 261, 267 can present additional surfaces for being printed over with product, advertising, price coding, and other information or images that are conveniently oriented toward customers passing by the carrier 205/package 207.

Upon formation of the package 207/carrier 205, a customer or other user can engage the package 207/carrier 205 by inserting one or more of his or her fingers against the respective handle flaps 275 to cause the respective handle flap 275 to fold downwardly at a respective fold line 277 to create an opening or space through which one or more finger can be inserted to engage the underside of the central panel 217 to lift, carry, or otherwise move/manipulate the package 207/carrier 205. During such engagement of the package 207/carrier 205, one or more of the handle flaps 275 can be positioned between the finger(s) of the user/customer and the central panel 217, e.g., for comfort, to avoid pinching, to more evenly distribute stresses across the package 207/carrier 205, etc.

The blanks according to the present disclosure can be, for example, formed from coated paperboard and similar materials. For instance, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In accordance with the above-described embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type of tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the disclosure, and/or within the skill or knowledge of the relevant art. Furthermore, certain features and characteristics of each embodiment may be selectively interchanged and applied to other illustrated and non-illustrated embodiments of the disclosure.

What is claimed is:

1. A carrier for holding a plurality of containers, the carrier comprising:

a central panel; and container retention features for engaging the plurality of containers, the container retention features include a plurality of container retention openings for at least partially receiving a respective container of the plurality of containers, a plurality of container retention tabs positioned extending into a respective container retention opening for engaging a respective container of the plurality of containers, and a plurality of edge retainers in the central panel comprising at least one corner edge retainer, at least one lateral edge retainer, and at least one longitudinal edge retainer, the corner edge retainer extending from a respective container retention tab of the plurality of container retention tabs and for facilitating engagement of the carrier with a container of the plurality of containers, the at least one longitudinal edge retainer defining a container retention edge positioned to engage the container of the plurality of containers and the at least one lateral edge retainer defines a container retention edge positioned to engage the container of the plurality of containers, the at least one longitudinal edge retainer and the at least one lateral edge retainer are foldably connected to the at least one corner edge retainer.

2. The carrier of claim 1, wherein the plurality of container retention tabs is foldably connected to the at least one corner edge retainer.

3. The carrier of claim 1, wherein the plurality of container retention tabs comprises a plurality of continuous segments, each segment of the plurality of continuous segments at least partially separable from a respective adjacent segment of the plurality of continuous segments at a respective cut.

4. The carrier of claim 3, wherein the plurality of container retention tabs comprises a first container retention tab and a second container retention tab positioned extending into the respective container retention opening for engaging a respective container of the plurality of containers.

5. A blank for forming a carrier for holding a plurality of containers, the blank comprising:

a central panel; and container retention features for engaging the plurality of containers when the carrier is formed from the blank, the container retention features include a plurality of container retention openings for at least partially receiving a respective container of the plurality of containers, a plurality of container retention tabs positioned extending into a respective container retention opening for engaging a respective container of the plurality of containers, and a plurality of edge retainers in the central panel comprising at least one corner edge retainer, at least one lateral edge retainer, and at least one longitudinal edge retainer, the corner edge retainer extending from a respective container retention tab of the plurality of container retention tabs and for facilitating engagement of the carrier with the plurality of containers when the carrier is formed from the blank, the at least one longitudinal edge retainer defining a container retention edge positioned to engage the container of the plurality of containers and the at least one lateral edge retainer defines a container retention edge positioned to engage the container of the plurality of containers, the at least one longitudinal edge retainer and the at least one lateral edge retainer are foldably connected to the at least one corner edge retainer.

6. The blank of claim 5, wherein the plurality of container retention tabs is foldably connected to the at least one corner edge retainer.

7. The blank of claim 5, wherein the plurality of container retention tabs comprises a plurality of continuous segments, each segment of the plurality of continuous segments at least partially separable from a respective adjacent segment of the plurality of continuous segments at a respective cut.

8. The blank of claim 7, wherein the plurality of container retention tabs comprises a first container retention tab and a second container retention tab positioned extending into the respective container retention opening for engaging a respective container of the plurality of containers when the carrier is formed from the blank.

9. A method of forming a carrier for holding a plurality of containers, the method comprising:

obtaining a blank comprising a central panel and container retention features, the container retention features include a plurality of container retention openings, a plurality of container retention tabs positioned extending into a respective container retention opening, and a plurality of edge retainers in the central panel comprising at least one corner edge retainer, at least one lateral edge retainer, and at least one longitudinal edge retainer, the corner edge retainer extending from a respective container retention tab of the plurality of container retention tabs;

positioning the blank such that the plurality of container retention openings is positioned for at least partially receiving a respective container of the plurality of containers, such that at least one of the plurality of container retention tabs is positioned for engaging a respective container of the plurality of containers, and such that the at least one edge retainer is positioned for facilitating engagement of the carrier with the plurality of containers, the at least one longitudinal edge retainer defining a container retention edge positioned to engage the container of the plurality of containers and the at least one lateral edge retainer defines a container retention edge positioned to engage the container of the plurality of containers, the at least one longitudinal edge retainer and the at least one lateral edge retainer are foldably connected to the at least one corner edge retainer, positioning the blank comprises positioning the container retention edge of the longitudinal edge retainer and the lateral edge retainer to engage the container of the plurality of containers.

10. The method of claim 9, wherein at least one of the plurality of container retention tabs is foldably connected to the at least one corner edge retainer.

11. The method of claim 9, wherein the plurality of container retention tabs comprises a plurality of continuous segments, each segment of the plurality of continuous segments at least partially separable from a respective adjacent segment of the plurality of continuous segments at a respective cut.

12. The method of claim 11, wherein the plurality of container retention tabs comprises a first container retention tab and a second container retention tab positioned extending into the respective container retention opening, and positioning the blank comprises positioning the second container retention tab for engaging a respective container of the plurality of containers.

13. A package, the package comprising:

a plurality of containers; and a carrier holding the plurality of containers, the carrier comprising:

a central panel; and container retention features engaging the plurality of containers, the container retention features include a plurality of container retention openings at least partially receiving a respective container of the plurality of containers, a plurality of container retention tabs positioned extending into a respective container retention opening engaging a respective container of the plurality of containers, and a plurality of edge retainers in the central panel comprising at least one corner edge retainer, at least one lateral edge retainer, and at least one longitudinal edge retainer, the corner edge retainer extending from a respective container retention tab of the plurality of container retention tabs and facilitating engagement of the carrier with a container of the plurality of containers, the at least one longitudinal edge retainer defining a container retention edge positioned to engage the container of the plurality of containers and the at least one lateral edge retainer defines a container retention edge positioned to engage the container of the plurality of containers, the at least one longitudinal edge retainer and the at least one lateral edge retainer are foldably connected to the at least one corner edge retainer.

14. The package of claim 13, wherein at least one of the plurality of container retention tabs is foldably connected to the at least one corner edge retainer.

15. The package of claim 13, wherein the plurality of container retention tabs comprises a plurality of continuous segments, each segment of the plurality of continuous segments at least partially separable from a respective adjacent segment of the plurality of continuous segments at a respective cut.

16. The package of claim 15, wherein the plurality of container retention tabs is a first container retention tab and a second container retention tab positioned extending into the respective container retention opening and engaging a respective container of the plurality of containers.

* * * * *